US010286274B1

(12) United States Patent
Carretta

(10) Patent No.: US 10,286,274 B1
(45) Date of Patent: May 14, 2019

(54) HOCKEY GOAL

(71) Applicant: Graziano Carretta, Richmond Hill (CA)

(72) Inventor: Graziano Carretta, Richmond Hill (CA)

( * ) Notice: Subject to any disclaimer, the term of this patent is extended or adjusted under 35 U.S.C. 154(b) by 0 days.

(21) Appl. No.: 15/990,984

(22) Filed: May 29, 2018

(51) Int. Cl.
*A63B 63/00* (2006.01)
*A63B 102/24* (2015.01)

(52) U.S. Cl.
CPC ..... *A63B 63/004* (2013.01); *A63B 2102/24* (2015.10)

(58) Field of Classification Search
CPC ..... A63B 63/004; A63B 2063/005
USPC ..... 273/398–402; 473/476–478
See application file for complete search history.

(56) References Cited

U.S. PATENT DOCUMENTS 3,698,715 A 10/1972 Browning
3,979,120 A 9/1976 Dietrich
4,579,344 A * 4/1986 Meggs ..... A63B 63/004 114/219
D353,426 S 12/1994 Amram
5,431,411 A * 7/1995 Padilla ..... A63B 63/004 273/127 C
5,516,114 A * 5/1996 Michlin ..... A63F 9/0278 24/30.5 S
5,681,231 A 10/1997 Reeves
7,121,965 B2 10/2006 Riley
9,180,353 B2 11/2015 Chen
2003/0144092 A1* 7/2003 Loverock ..... A63B 63/004 473/478
2004/0072633 A1 4/2004 Webb
2004/0214667 A1* 10/2004 Riley ..... A63B 63/004 473/478
2006/0232013 A1* 10/2006 Quinn ..... A63B 24/0021 273/400
2011/0165973 A1* 7/2011 Lopez ..... B62B 1/14 473/478
2012/0035005 A9 2/2012 Forster
2012/0178555 A1* 7/2012 O'Scanaill ..... A63B 63/004 473/478
2013/0157790 A1* 6/2013 Nalepa ..... A63B 63/004 473/478
2016/0023084 A1* 1/2016 Gravel ..... A63B 71/0036 473/478

FOREIGN PATENT DOCUMENTS

CA 2465419 2/2013

* cited by examiner

*Primary Examiner* — Mark S Graham

(57) ABSTRACT

The hockey goal comprises left and right vertical goalposts, a front crossbar, left and right elbows, a lower rear frame, an upper rear frame, a crinkle bar, a second crinkle bar, a net, a bumper cushion, and a wear plate. The left vertical goalpost, right vertical goalpost, front crossbar, left elbow, and right elbow comprise a goal opening at the front of the hockey goal. The lower rear frame and upper rear frame are fabricated from square tubing and comprise a semi-elliptical support for the net on the rear side of the goal opening. The wear plate supports the lower rear frame. The bumper cushion absorbs the impact of a puck entering the hockey goal and couples to the hockey goal via twine that is laced through the crinkle bar.

8 Claims, 5 Drawing Sheets

HOCKEY GOAL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports equipment, more specifically, a hockey goal.

SUMMARY OF INVENTION

The hockey goal comprises left and right vertical goalposts, a front crossbar, left and right elbows, a lower rear frame, an upper rear frame, a crinkle bar, a second crinkle bar, a net, a bumper cushion, and a wear plate. The left vertical goalpost, right vertical goalpost, front crossbar, left elbow, and right elbow comprise a goal opening at the front of the hockey goal. The lower rear frame and upper rear frame are fabricated from square tubing and comprise a semi-elliptical support for the net on the rear side of the goal opening. The wear plate supports the lower rear frame. The bumper cushion absorbs the impact of a puck entering the hockey goal and couples to the hockey goal via twine that is laced through the crinkle bar. The crinkle bar and the second crinkle bar is coupled to the left and right goalposts, crossbar, and lower rear frame, and is collectively used to attach a net.

An object of the invention is to provide a goal for use in the game of hockey.

Another object of the invention is to avoid the need for a center vertical support found on other hockey goals A further object of the invention is to provide a replaceable wear plate on the bottom of the hockey goal.

Yet another object of the invention is to provide a crinkle bar, and a second crinkle bar for attaching a net.

Yet another object of the invention is to provide a crinkle bar, and a second crinkle bar for attaching the bumper cushion.

These together with additional objects, features and advantages of the hockey goal will be readily apparent to those of ordinary skill in the art upon reading the following detailed description of the presently preferred, but nonetheless illustrative, embodiments when taken in conjunction with the accompanying drawings.

In this respect, before explaining the current embodiments of the hockey goal in detail, it is to be understood that the hockey goal is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hockey goal.

It is therefore important that the claims be regarded hockey goal including such equivalent construction insofar as they do not depart from the spirit and scope of the hockey goal. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
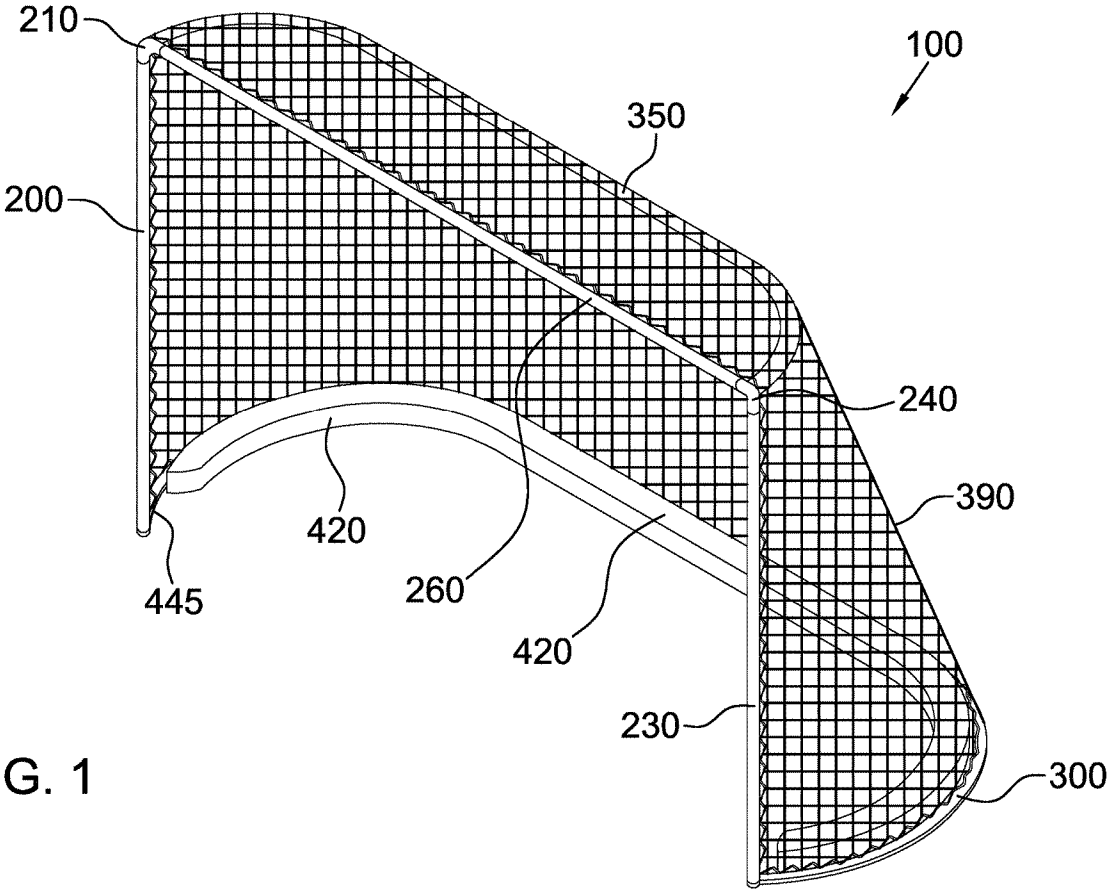
FIG. 1 is a perspective view of an embodiment of the disclosure.
Figure 2:
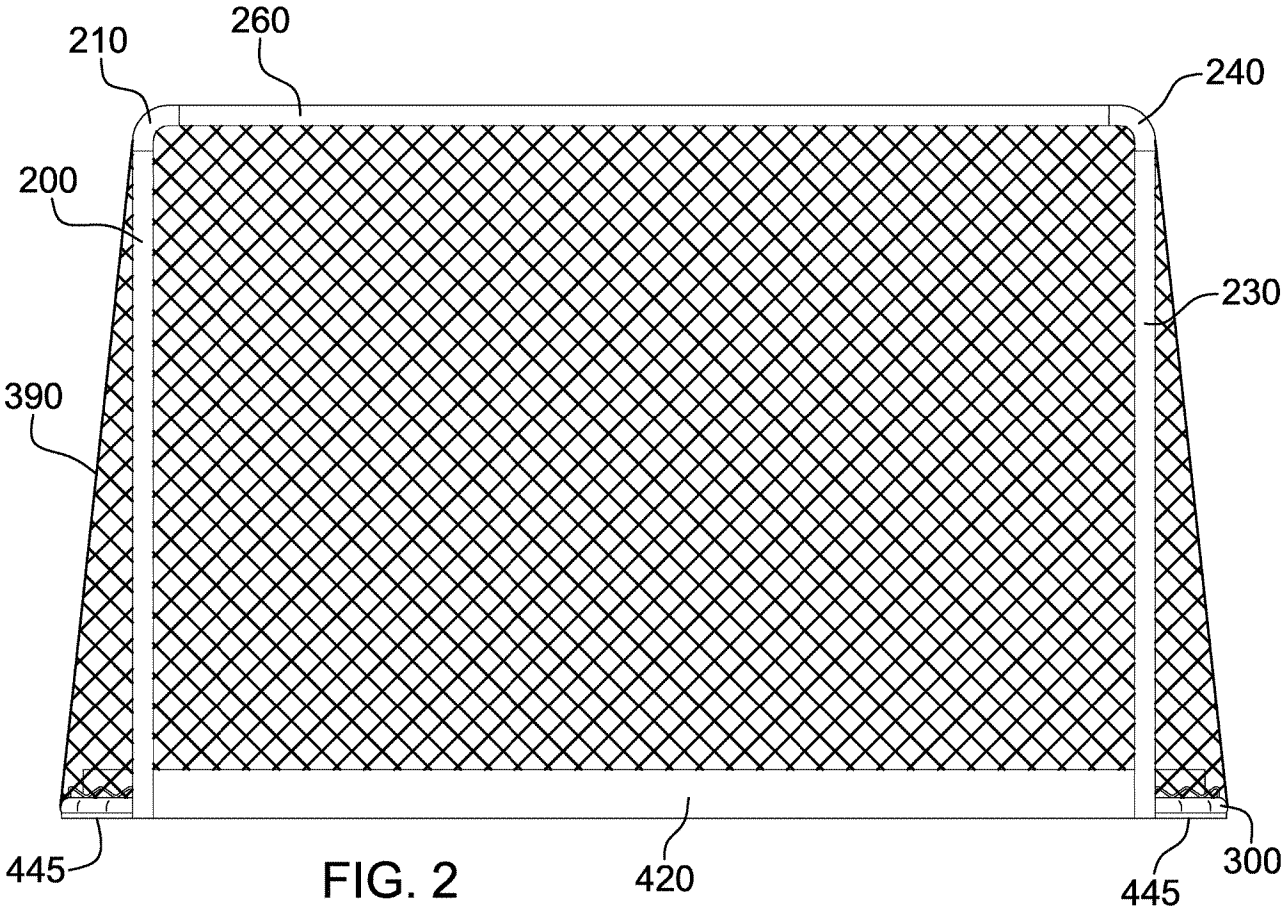
FIG. 2 is a front view of an embodiment of the disclosure.
Figure 3:
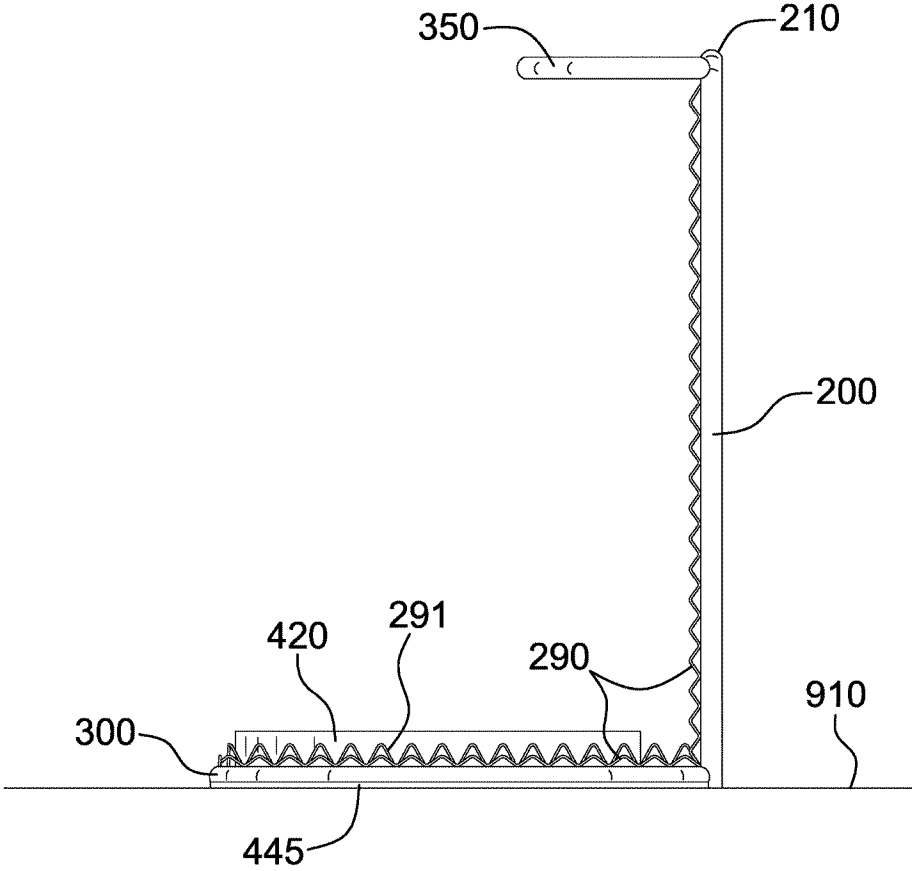
FIG. 3 is a side view of an embodiment of the disclosure with the net omitted for clarity.
Figure 4:
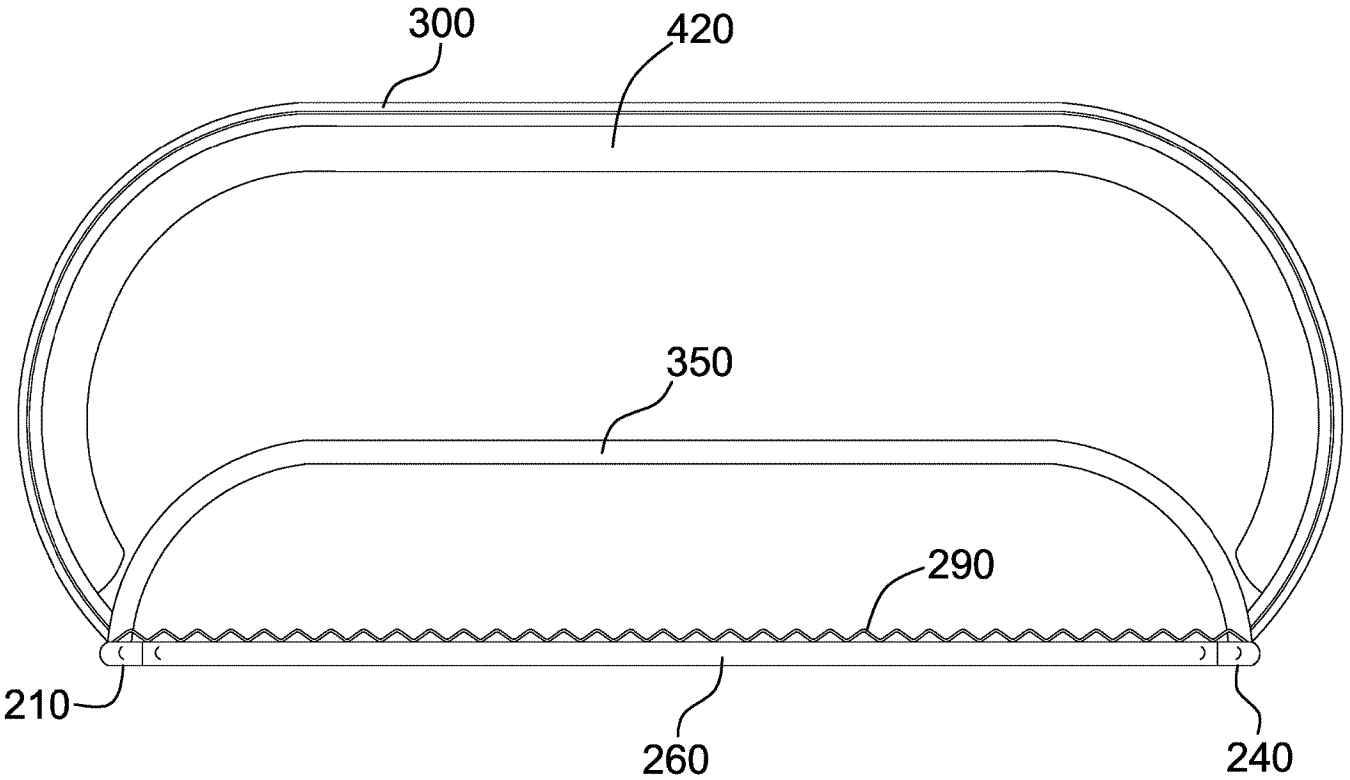
FIG. 4 is a top view of an embodiment of the disclosure with the net omitted for clarity.
Figure 5:
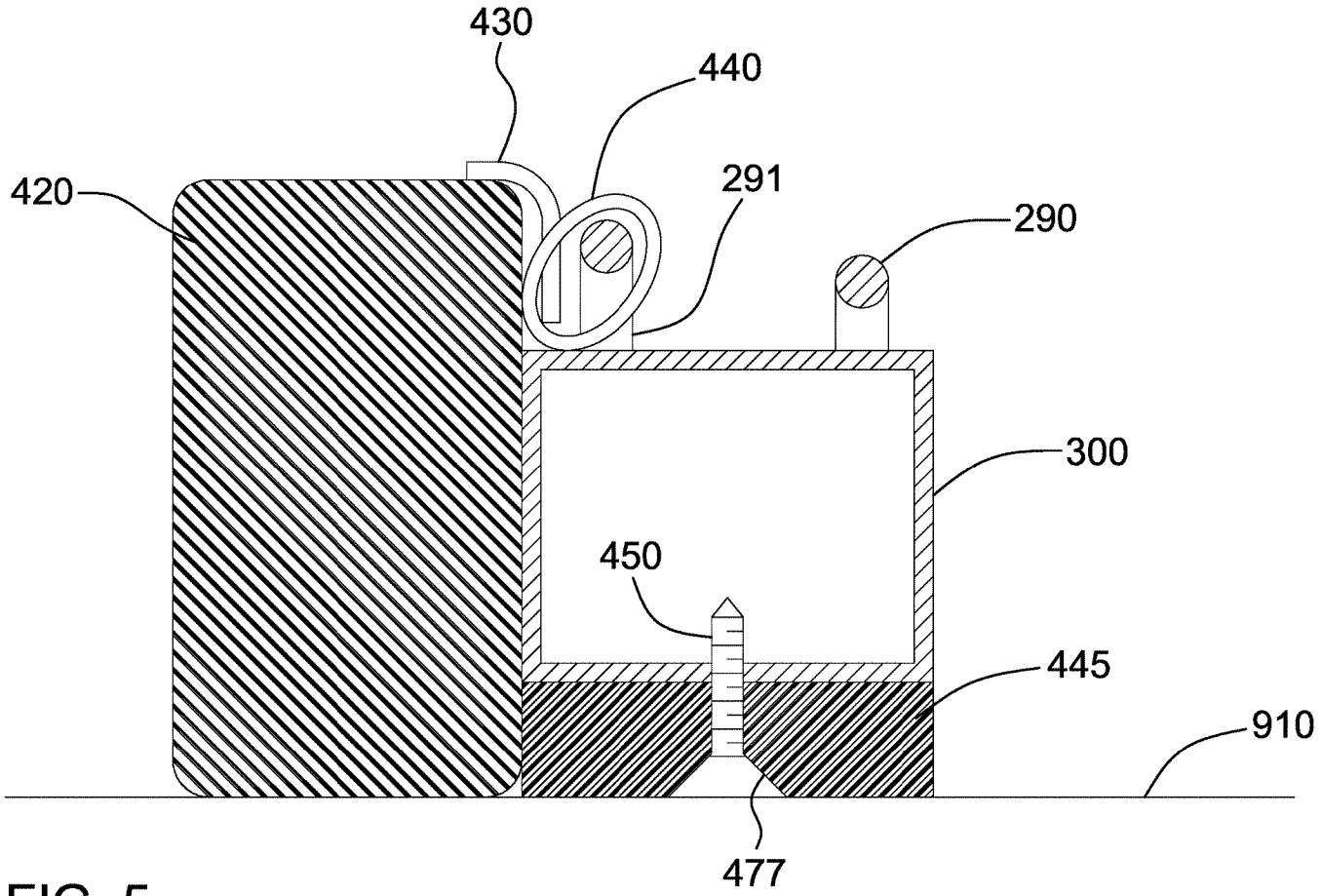
FIG. 5 is a detail view of an embodiment of the disclosure illustrating the attachment of the bumper cushion and wear plate as seen from the side.

Detailed reference will now be made to a first potential embodiment of the disclosure, which is illustrated in FIGS. 1 through 5.

The hockey goal 100 (hereinafter invention) comprises a left vertical goalpost 200, a right vertical goalpost 230, a front crossbar 260, a left elbow 210, a right elbow 240, a lower rear frame 300, an upper rear frame 350, a crinkle bar 290, a second crinkle bar 291, a net 390, a bumper cushion 420, and a wear plate 445. The invention 100 is a regulation size goal for use in the game of ice hockey.

The invention 100 does not require a center rear vertical support found on other ice hockey goals. The invention 100 incorporates the wear plate 445 under the lower rear frame 300, and incorporates the crinkle bar 290 as well as the second crinkle bar 291 on top of the lower rear frame 300, which are not found on other ice hockey goals.

Throughout this disclosure, directional terms are used as follows: up and down, and related terms such as top and bottom, use a gravitational frame of reference where down is the direction that gravity pulls an object and up is the opposite of down. Front, left, and right are defined relative to a hockey player (not illustrated in the figures) standing at center ice and looking at the invention 100; front is the side of the invention 100 that is closest to the hockey player, left is the side of the invention 100 that is on left side of the hockey player, and right is the side of the invention 100 that is on right side of the hockey player. Rear is the side of the invention 100 that is opposite the front of the invention 100.

The left vertical goalpost 200 may be a vertical armature located on the left front side of the invention 100. The left vertical goalpost 200 may be fabricated from round pipe. As a non-limiting example, the left vertical goalpost 200 may be fabricated from 2" NPS steel pipe. The top of the left vertical goalpost 200 may be coupled to the bottom of the left elbow 210.

The left elbow 210 may be a 90-degree fitting that couples the left vertical goalpost 200 and the front crossbar 260. As a non-limiting example, the left elbow 210 may be a 2" NPS short radius elbow.

The right vertical goalpost 230 may be a vertical armature located on the right front side of the invention 100. The right vertical goalpost 230 may be fabricated from round pipe. As a non-limiting example, the right vertical goalpost 230 may be fabricated from 2" NPS steel pipe. The top of the right vertical goalpost 230 may be coupled to the bottom of the right elbow 240.

The right elbow 240 may be a 90-degree fitting that couples the right vertical goalpost 230 and the front crossbar 260. As a non-limiting example, the right elbow 240 may be a 2" NPS short radius elbow.

The front crossbar 260 may be a horizontal armature located on the top front side of the invention 100. The front crossbar may be fabricated from round pipe. As a non-limiting example, the front crossbar 260 may be fabricated from 2" NPS steel pipe. The left end of the front crossbar 260 may be coupled to the right side of the left elbow 210. The right end of the front crossbar 260 may be coupled to the left side of the right elbow 240.

The left vertical goalpost 200, the right vertical goalpost 230, the front crossbar 260, and the ground 910 define a goal opening of the invention 100. A point is scored when a puck (not illustrated in the figures) completely passes through the goal opening. The invention 100 may meet regulations concerning dimensions established by one or more hockey leagues. As a non-limiting example, some embodiment of the invention 100 may provide a distance between the left vertical goalpost 200 and the right vertical goalpost 230 that is 72 inches wide and a height from the ground 910 to the bottom of the front crossbar 260 that is 48 inches.

The lower rear frame 300 may be a horizontal armature at the bottom rear of the invention 100. The lower rear frame 300 may be coupled to the rear side of the left vertical goalpost 200 and to the rear side of the right vertical goalpost 230. The lower rear frame 300 may be semi-elliptical in shape and may extend towards the rear side of the invention 100. The lower rear frame 300 may extend to the left of the left vertical goalpost 200 and to the right of the right vertical goalpost 230. In some embodiments, the width of the lower rear frame 300 as measured from left-to-right may be 85 to 91 inches. In some embodiments, the depth of the lower rear frame 300 as measured from a line drawn between the front side of the left vertical goalpost 200 and the front of the right vertical goalpost 230 to the rear side of the lower rear frame 300 may be 32 to 44 inches.

The lower rear frame 300 may be fabricated from square tubing. In some embodiments, the lower rear frame 300 may be fabricated from 2 inch by 0.083 inch steel square tube. The horizontal leg may comprise a plurality of wear plate mounting holes (not illustrated in the figures). In some embodiments, the left end of the lower rear frame 300 may be welded to the rear side of the left vertical goalpost 200 and the right end of the lower rear frame 300 may be welded to the rear side of the right vertical goalpost 230. The lower rear frame 300 may be separated from the ground 910 by the wear plate 445 that is coupled to the lower surface of the lower rear frame 300.

The wear plate 445 may be a plastic spacer, which has substantially the same horizontal outline as the lower rear frame 300. In some embodiments, the height of the wear plate 445 may be ¾ inch. The wear plate 445 may be coupled to the lower rear frame 300 using a plurality of wear plate mounting screws 450 passing through one of a plurality of wear plate mounting holes 477 to the lower surface of the lower rear frame 300.

The upper rear frame 350 may be a horizontal armature at the top rear of the invention 100. The upper rear frame 350 may be coupled to the rear side of the left elbow 210 and to the rear side of the right elbow 240. The upper rear frame 350 may be semi-elliptical in shape and may extend towards the rear side of the invention 100. In some embodiments, the depth of the upper rear frame 350 as measured from the front side of the front crossbar 260 to the front side of the upper rear frame 350 may be 18 inches.

The upper rear frame 350 may be fabricated from square tubing. In some embodiments, the upper rear frame 350 may be fabricated from 1.25 inch by 1.25 inch by 0.120 inch square steel tube. In some embodiments, the left end of the upper rear frame 350 may be welded to the rear side of the left elbow 210 and the right end of the upper rear frame 350 may be welded to the rear side of the right elbow 240.

The crinkle bar 290 and the second crinkle bar 291 may be a wire bent into a zig-zag pattern. The first crinkle bar 290 and/or the second crinkle bar 291 may be coupled to the rear surface of the left vertical goalpost 200, to the rear surface of the right vertical goalpost 230 and to the rear surface of the front crossbar 260. The crinkle bar 290 and/or the second crinkle bar 291 may be coupled to the top surface of the lower rear frame 300. The crinkle bar 290 and/or the second crinkle bar 291 may be used to couple the net 390 to the invention 100. As a non-limiting example, the net 390 may be coupled to the crinkle bar 290 and/or the second crinkle bar 291 using a combination of nylon cable ties and/or twine 440 laced through the net 390 and the crinkle bar 290 and/or the second crinkle bar 291.

The net 390 may be a rope mesh that is used to capture the puck when the puck passes through the goal opening. The net 390 may comprise a shape that conforms to the contour of the left vertical goalpost 200, the right vertical goalpost 230, the front crossbar 260, the upper rear frame 350 and the lower rear frame 300. Specifically, the net 390 may comprise a top area having the same size and shape as the horizontal outline of the front crossbar 260 and the upper rear frame 350 and may have a side area that wraps from the left vertical goalpost 200 to the right vertical goalpost 230 between the upper rear frame 350 and the lower rear frame 300.

The bumper cushion 420 may be coupled to the rear ½ of the lower rear frame 300. The bumper cushion 420 may absorb the impact of the puck as the puck strikes the rear of the invention 100. The cross-sectional shape of the bumper cushion 420 may be rectangular.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "square tubing" is a metal square tube that is bent along any axis. A square tube presents a square cross-section.

As used herein, the words "couple", "couples", "coupled" or "coupling", refer to connecting, either directly or indirectly, and does not necessarily imply a mechanical connection.

As used in this disclosure, the term "flush" is used to describe that a first surface is aligned with a second surface.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the term "mesh" refers to an openwork fabric made from threads, yarns, cords, wires, strands, or lines that are woven, knotted, or otherwise twisted or intertwined at regular intervals. A mesh may also be referred to as a net.

As used herein, "nominal pipe size" or "NPS" is a North American set of standard sizes specifying the outside diameter of pipes. The term NB (nominal bore) is also frequently used interchangeably with NPS.

As used in this disclosure, a "radius" refers to a line segment that: 1) connects the center of a circle to the circumference of the circle; or, 2) connects the center of a sphere to the surface of the sphere; or, 3) is one half the span of the diameter of an object.

As used herein, the term "grommet" refers to an eyelet placed in a hole in a sheet or panel to protect or insulate a rope, nylon cable twine or lacing passed through it or to protect the sheet or pane from being torn.

As used herein, the term "semi-elliptical" refers to a two-dimensional shape that resembles a portion of an ellipse. The portion of an ellipse may be, but is not required to be, exactly ½ of an ellipse. It is permissible that the shape resembles an ellipse without meeting the rigorous mathematical defintion of an ellipse.

As used herein, the terms "short radius elbow" and "long radius elbow" refer to an industry standard classification of pipe elbows. The difference between long radius elbows and short radius elbows is the length and curvature. A short radius elbow will give the piping a sharper turn than a long radius elbow. In a long radius elbow the radius of curvature is 1.5 times the nominal diameter. In a short elbow the radius of curvature is 1.0 times the nominal diameter of the pipe. Long radius elbows give less frictional resistance to the fluid than the short elbows. Long radius elbows create lesser pressure drop than short radius elbows. Short radius is less costly than long radius elbows. Short radius elbows are used where there is scarcity of space.

As used herein, the word "substantially" indicates that two or more values are the same except for a margin of error related to variances in materials, manufacturing processes, craftsmanship, installation, environmental conditions, or other factors that may influence the values and that such margin of error is tolerable.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hockey goal comprising:

a left vertical goalpost, a right vertical goalpost, a front crossbar, a left elbow, a right elbow, a lower rear frame, an upper rear frame, a crinkle bar, a second crinkle bar, a net, a bumper cushion, and a wear plate;

wherein the hockey goal is a regulation size goal for use in the game of ice hockey;

wherein the hockey goal does not require a center rear vertical support found on other ice hockey goals;

wherein the left vertical goalpost is a vertical armature located on the left front side of the hockey goal;

wherein the top of the left vertical goalpost is coupled to the bottom of the left elbow;

wherein the left elbow is a 90 degree fitting that couples the left vertical goalpost and the front crossbar;

wherein the right vertical goalpost is a vertical armature located on the right front side of the hockey goal;

wherein the top of the right vertical goalpost is coupled to the bottom of the right elbow;

wherein the right elbow is a 90 degree fitting that couples the right vertical goalpost and the front crossbar;

wherein the front crossbar is a horizontal armature located on the top front side of the hockey goal;

wherein the left end of the front crossbar is coupled to the right side of the left elbow;

wherein the right end of the front crossbar is coupled to the left side of the right elbow;

wherein the left vertical goalpost, the right vertical goalpost, the front crossbar, and the ground define a goal opening of the hockey goal;

wherein the lower rear frame is a horizontal armature at the bottom rear of the hockey goal;

wherein the lower rear frame is coupled to the rear side of the left vertical goalpost and to the rear side of the right vertical goalpost;

wherein the lower rear frame is semi-elliptical in shape and extends towards the rear side of the hockey goal;

wherein the lower rear frame extends to the left of the left vertical goalpost and to the right of the right vertical goalpost;

wherein the lower rear frame is fabricated from square tubing;

wherein the bumper cushion is coupled to a crinkle deflector bar;

wherein the left end of the lower rear frame is welded to the rear side of the left vertical goalpost and the right end of the lower rear frame is welded to the rear side of the right vertical goalpost;

wherein the lower rear frame is separated from the ground by the wear plate that is coupled to the lower surface of the lower rear frame;

wherein the wear plate is a plastic spacer which has substantially the same horizontal outline as the lower rear frame;

wherein the wear plate is coupled to the lower rear frame using a plurality of wear plate mounting screws passing through the plurality of wear plate mounting holes and threading into the bottom surface of the lower rear frame.

2. The hockey goal according to claim 1 wherein the upper rear frame is a horizontal armature at the top rear of the hockey goal;

wherein the upper rear frame is coupled to the rear side of the left elbow and to the rear side of the right elbow;

wherein the upper rear frame is semi-elliptical in shape and extends towards the rear side of the hockey goal.

3. The hockey goal according to claim 1 wherein the upper rear frame is fabricated from square tubing.

4. The hockey goal according to claim 3 wherein the crinkle bar and the second crinkle bar is a wire bent into a zig-zag pattern;

wherein the crinkle bar and the second crinkle bar is coupled to the rear surface of the left vertical goalpost, to the rear surface of the right vertical goalpost and to the rear surface of the front crossbar;

wherein the crinkle bar and the second crinkle bar is coupled to the top surface of the lower rear frame;

wherein a net is coupled to the crinkle bar and the second crinkle bar using a combination of nylon cable ties and twine laced through the net and the crinkle bar and the second crinkle bar.

5. The hockey goal according to claim 4 wherein the net is a rope mesh that is used to capture a puck when the puck passes through the goal opening;

wherein the net comprises a shape that conforms to the contour of the left vertical goalpost, the right vertical goalpost, the front crossbar, the upper rear frame and the lower rear frame.

6. The hockey goal according to claim 5 wherein the bumper cushion is coupled to the rear ½ of the lower rear frame;

wherein the bumper cushion absorbs the impact of a puck as the puck strikes the rear of the hockey goal;

wherein the cross-sectional shape of the bumper cushion is rectangular.

7. The hockey goal according to claim 6 wherein the rear side of the bumper cushion is coupled to the crinkle deflector bar using nylon cable ties and twine laced through grommets found in the bumper cushion.

8. The hockey goal according to claim 7 wherein the left end of the upper rear frame is welded to the rear side of the left elbow and the right end of the upper rear frame is welded to the rear side of the right elbow.

* * * * *